US005981935A

United States Patent [19]

Raverdy

[11] Patent Number: 5,981,935

[45] Date of Patent: Nov. 9, 1999

[54] RADIOLOGICAL IMAGE INTENSIFIER TUBE HAVING AN ALUMINUM LAYER

[75] Inventor: Yvan Raverdy, Bas Bernin, France

[73] Assignee: Thomson Tubes Electroniques, Meudon la Foret, France

[21] Appl. No.: 08/997,724

[22] Filed: Dec. 24, 1997

[30] Foreign Application Priority Data

Dec. 27, 1996 [FR] France ..... 96 16114

[51] Int. Cl.[6] ..... H01J 40/14

[52] U.S. Cl. ..... 250/214 VT; 313/543; 313/106

[58] Field of Search ..... 250/214 VT, 208.1; 313/543, 103 R, 483, 527, 106, 107

[56] References Cited

U.S. PATENT DOCUMENTS

| | | | |
|---|---|---|---|
| 3,911,165 | 10/1975 | Kanai et al. | 313/466 |
| 5,146,076 | 9/1992 | Raverdy et al. | 250/214 VT |
| 5,248,874 | 9/1993 | Raverdy | 250/214 VT |
| 5,256,870 | 10/1993 | Raverdy et al. | 250/214 VT |
| 5,315,103 | 5/1994 | Raverdy et al. | 250/214 VT |

FOREIGN PATENT DOCUMENTS

| | | |
|---|---|---|
| 0 067 470 A1 | 12/1982 | European Pat. Off. . |
| 0 610 872 A2 | 8/1994 | European Pat. Off. . |
| 2 152 731 | 4/1973 | France . |
| 2 209 213 | 6/1974 | France . |
| 2 217 793 | 9/1974 | France . |
| 25 53 507 A1 | 6/1977 | Germany . |
| 40 01 516 A1 | 7/1991 | Germany . |

OTHER PUBLICATIONS

Patent Abstracts of Japan, vol. 96, No. 5, May 31, 1996, and JP 08 022784 A, Jan. 23, 1996.

*Primary Examiner*—Que T. Le

*Attorney, Agent, or Firm*—Oblon, Spivak, McClelland, Maier & Neustadt, P.C.

[57] ABSTRACT

The disclosure relates to radiological image intensifier tubes comprising a vacuum electron tube and a luminescent observation screen comprising means to improve the contrast of the image. These means consist of a layer of aluminium with a thickness of at least 1 micrometer, partially absorbent for the incident electrons, placed in the path of the electrons generated by the tube and in the vicinity of the layer of luminophores. The deposited layer has the effect of reducing, firstly, the quantity of electrons re-emitted from the observation screen to the tube and, secondly, the proportion of these electrons that return to strike the layer of luminophores. Application to radiological type image intensifier tubes.

4 Claims, 1 Drawing Sheet

RADIOLOGICAL IMAGE INTENSIFIER TUBE HAVING AN ALUMINUM LAYER

BACKGROUND OF THE INVENTION

1. Field of the Invention

The invention relates to radiological image intensifier tubes (RII tubes) using a vacuum electron tube and a luminescent observation screen.

The luminescent observation screen of an RII tube has the role of generating a visible light image when the screen is excited by an electron beam that strikes its photoluminescent surface. The invention relates more particularly to the luminescent observation screen comprising means to improve the contrast of the image.

Image intensifier tubes are vacuum tubes comprising an input screen located at the front of the tube, an electronic optical system and an image observation screen located at the rear of the tube, on the side of an output window of this tube.

In radiological image intensifier tubes, the input screen furthermore has a scintillator screen that converts the incident X photons into visible photons.

The visible photons excite a photocathode which, in response, generates an electron flux. This electron flux is then transmitted by an electronic optical system that focuses the electrons and directs them to the observation screen. The observation screen has one or more layers of luminophore grains deposited on a transparent glass support. The luminophores struck by the electrons then produce visible light from the exterior of the tube through the transparent support.

2. Description of the Prior Art

FIG. 1 gives a schematic view of a radiological type of image intensifier tube of this kind.

The intensifier tube 1 has a glass casing 2 of which one end, in front of the tube, is closed by an input window 3 exposed to radiation by X photons.

The second end of the casing forming the rear tube is closed by the observation screen 4 which is transparent to light.

The X-rays are converted into visible light rays by a scintillator screen 5. The visible light rays excite a photocathode 6 which, in response, produces electrons. These electrons are extracted from the photocathode 6 and accelerated to the observation screen 4 by means of different electrodes 7 and an anode 8 positioned along a longitudinal axis 9 of the tube and forming the electronic optical system.

In the example shown, the observation screen 4 is formed by a transparent element made of glass attached in an imperviously sealed manner to the casing 2. This glass element furthermore, in the example shown, comprises a support that bears luminophores 10 for example.

In certain embodiments of image intensifier tubes, the setting up of the acceleration potential of the electrons coming from the photocathode of the tube is done by a grid, under the acceleration voltage, that is positioned in the vicinity of the observation screen. The accelerated electrons go through the grid reaching the luminophores 10, of the observation screen, which produce visible light.

In other embodiments, the acceleration potential is obtained by a voltage applied to a thin layer of conductive material for example a metal deposited directly on the layer of luminophores of the observation screen. The small thickness of this metal layer enables the electrons to pass to the luminophores without great loss. In present embodiments, the thickness of the metal layer, which is made of aluminium for example, is about 0.3 micrometers.

This very small thickness is chosen so that the layer is transparent to electrons, in order that these electrons may reach the photocathode without losses. Indeed, aluminum is not naturally transparent to electrons except in very small thicknesses.

Furthermore, it has already been proposed, for cathode-ray tubes and not for radiological image intensifier tubes, to coat the aluminum layer with a carbon layer in order to limit the production of secondary electrons by the luminophore layer. For, carbon is a material with a very low secondary emission coefficient. Therefore, it does not generate excessive secondary electrons when it is struck by the electrons of the incident beam and furthermore it is relatively transparent to these incident electrons (which are high-energy electrons) but is absorbent to the secondary electrons which are transmitted by the layer of luminophores.

The emission of secondary electrons is inconvenient for the following reason. In the image intensifier tubes, the accelerated electrons coming from the photocathodes strike the layer of luminophores prompting an emission of photons in the visible light domain representing the radiological image. If we consider a beam of incident electrons Ei (see FIG. 1) striking the luminophores in a zone Z of the observation screen, these luminophores in turn, by the impact of the incident electrons Ei, produce re-emitted electrons Er that are directed towards the interior of the tube and then again fall on the luminophores of the observation screen at a place which is not the place at which they were emitted. This phenomenon is parasitic with respect to the initial image produced by the beam of incident electrons Ei. Hereinafter, these re-emitted electrons shall be called back-scattered electrons.

In present-days structures, the back-scattered electrons represent about 20% of the beam of incident electrons EI and are highly parasitic with respect to the image produced by the observation screen. The back-scattered electrons get dispersed when they are emitted into the tube. When they fall on the observation screen, accelerated by the bias voltages of the tube, these back-scattered electrons excite the luminophores of the observation screen in a totally distributed way. This secondary phenomenon produces a background noise expressed by a reduction of the contrast of the image.

In an unexpected way, it has been perceived that it is possible to obtain an equally efficient result without depositing any carbon layer, by using solely the properties of aluminium and choosing an aluminum layer thickness that is far greater than what normally ought to be chosen, given the low transparency of this material to electrons.

The fact is that aluminium has a secondary emission coefficient low enough for it to play partly the same role as the carbon layer. The aluminum layer may then constitute a single luminophore coating layer. The manufacture of the RII tube is thereby simplified.

SUMMARY OF THE INVENTION

This is why the invention proposes an RII tube comprising a vacuum electron tube and a luminescent observation screen (20), the screen having a glass support on which a layer of luminophores is deposited, the observation screen producing a light image when the luminophores are excited by an electron beam and the layer of luminophores being coated with an aluminum layer, wherein the aluminum layer has a thickness of at least 1 micrometer in order to reduce firstly the quantity of electrons re-emitted from the observation screen towards the tube and, secondly, the proportion of these electrons that return to strike the layer of luminophores.

The aluminium layer will act as a filter of back-scattered electrons by absorbing, at an initial stage, back-scattered electrons when, at the time of their generation by the impact of the beam of incident electrons Ei on the luminophores, they cross the aluminum layer in the direction opposite that of the beam of incident electrons and by absorbing, at a second stage, other back-scattered electrons when they again cross the same aluminum layer while falling back to the observation screen, in the same direction as the incident electrons.

The aluminum layer takes the form of a coating that is deposited, in principle, directly on the luminophores of the observation screen but could possibly be on a support located in the path of the incident electrons in the vicinity of the observation screen.

The coating also fulfills the function of setting up the acceleration potential of the electrons throughout the surface of the luminophores. This is necessary in the case of the observation screen of the image intensifier tubes.

The thickness of the aluminum layer is preferably 1 to 3 micrometers. A value of 1.5 to 2 micrometers is very appropriate.

The aluminum layer may be also separated by a small distance from the luminophores by the vacuum of the tube. In this case, the coating is supported by a grid of small thickness.

BRIEF DESCRIPTION OF THE DRAWINGS

Other features and advantages of the invention shall appear from the following description made with reference to the appended drawings, of which.

DESCRIPTION OF A PREFERRED EMBODIMENT

Figure 1:
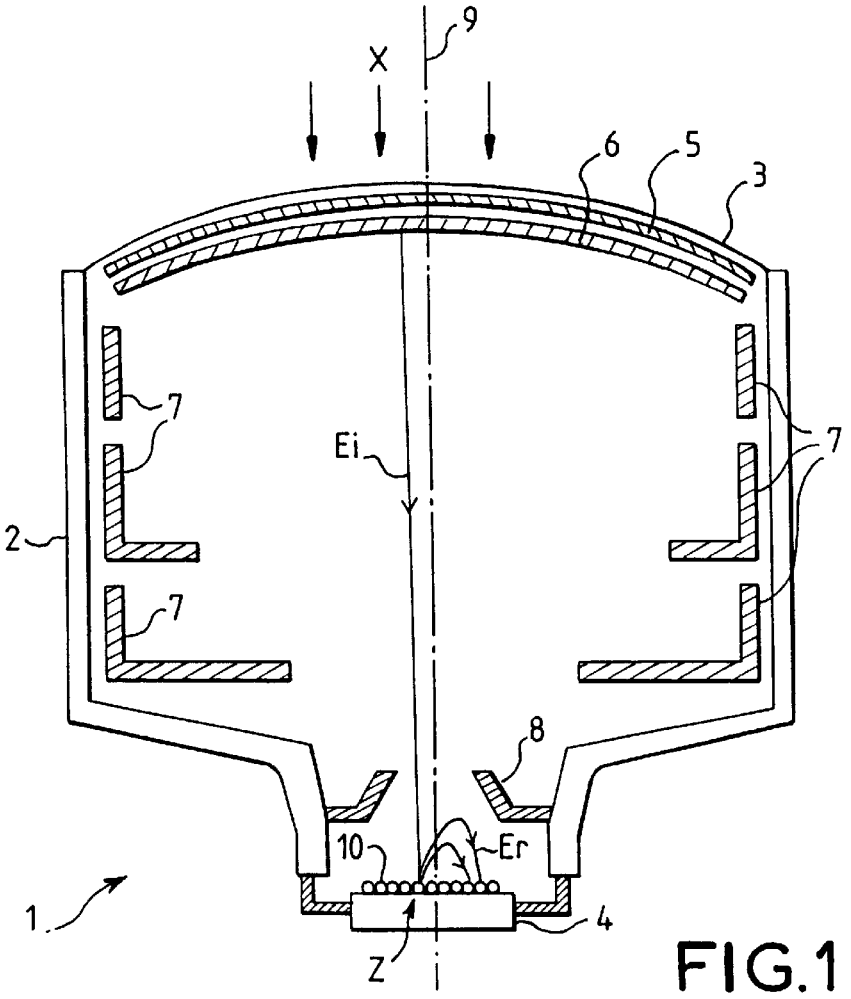
FIG. 1, already described, represents the structure of an image intensifier tube according to the prior art.
Figure 2:
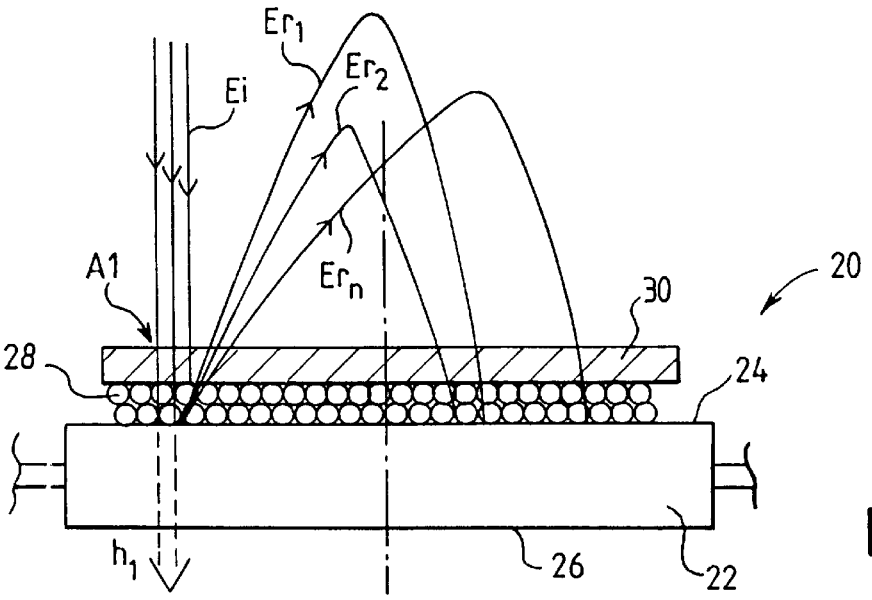
FIG. 2 shows an exemplary embodiment of an observation screen, according to the invention, for the radiological image intensifier tube of FIG. 1.

An observation screen 20 comprises:

a light-transparent glass support 22 hermetically sealing the lower part of the tube, not shown in the figure. The glass support has an internal face 24 located within the tube and an external face 26 external to the tube enabling the observation of the image generated by the observation screen, layers of luminophores 28 deposited on the internal face 24 of the glass support, an aluminum layer 30 with a thickness of about 2 micrometers deposited on the layers of luminophores 28. A potential for the acceleration of electrons is applied to this aluminum layer.

A beam of incident electrons Ei crosses the aluminum layer 30 with a loss of electrons, in a zone A1 of the observation screen, and excites the layers of luminophores 28 producing a light emission h1, visible through the glass support 22, and back-scattered electrons Er1, Er2, . . . , Ern. These back-scattered electrons, generated by the luminophores, are sent back into the tube and are partially absorbed, first of all while crossing the aluminum layer 30 in their movement towards the interior of the tube. Then they are again partially absorbed a second time, when falling back on the observation screen, in being attracted by the bias potential applied to the aluminum layer. In all, with an aluminum thickness of 2 micrometers approximately and despite the loss suffered by the incident electrons Ei going through the aluminum layer 30, the reduction of the back-scattered electrons absorbed by this aluminum layer leads to a substantial improvement of the contrast of the image.

What is claimed is:

1. A radiological image intensifier tube comprising a vacuum electron tube and a luminescent observation screen, the screen having a glass support on which a layer of luminophores is deposited, the observation screen producing a light image when the luminophores are excited by an electron beam and the layer of luminophores being coated with an aluminum layer, wherein the aluminum layer has a thickness of at least 1 micrometer in order to reduce firstly the quantity of electrons re-emitted from the observation screen towards the tube and, secondly, the proportion of these electrons that return to strike the layer of luminophores.

2. A radiological image intensifier tube according to claim 1, wherein the thickness of the aluminum layer ranges from about 1 to 3 micrometers.

3. A radiological image intensifier tube according to claim 2, wherein the layer has a thickness of about 2 micrometers.

4. A radiological image intensifier tube according to one of the claims 1 to 3, wherein the layer is deposited directly on the luminophores.

* * * * *